US010480513B2

(12) United States Patent
Mlsna

(10) Patent No.: US 10,480,513 B2
(45) Date of Patent: Nov. 19, 2019

(54) INTERMEDIATE DISCHARGE PORT FOR A COMPRESSOR

(71) Applicant: TRANE INTERNATIONAL INC., Davidson, NC (US)

(72) Inventor: Eric S. Mlsna, Cashton, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 15/758,253

(22) PCT Filed: Sep. 14, 2016

(86) PCT No.: PCT/US2016/051711
§ 371 (c)(1),
(2) Date: Mar. 7, 2018

(87) PCT Pub. No.: WO2017/048830
PCT Pub. Date: Mar. 23, 2017

(65) Prior Publication Data

US 2018/0245595 A1 Aug. 30, 2018

Related U.S. Application Data

(60) Provisional application No. 62/218,091, filed on Sep. 14, 2015.

(51) Int. Cl.
*F04C 29/12* (2006.01)
*F25B 1/04* (2006.01)
(Continued)

(52) U.S. Cl.
CPC ..... *F04C 29/12* (2013.01); *F04C 18/0215* (2013.01); *F04C 28/16* (2013.01);
(Continued)

(58) Field of Classification Search
CPC combination set(s) only.
See application file for complete search history.

(56) References Cited

U.S. PATENT DOCUMENTS 4,818,195 A * 4/1989 Murayama ..... F04C 18/0215 418/15
2003/0202886 A1 10/2003 Choi
(Continued)

FOREIGN PATENT DOCUMENTS

KR 10-2014-0136795 A 12/2014

OTHER PUBLICATIONS

International Search Report and Written Opinion; International Patent Application No. PCT/US2016/051711, dated Dec. 26, 2016 (11 pages).

(Continued)

*Primary Examiner* — Elizabeth J Martin
(74) *Attorney, Agent, or Firm* — Hamre, Schumann, Mueller & Larson, P.C.

(57) ABSTRACT

An intermediate discharge port in a scroll compressor and a method for controlling part-load efficiency of a scroll compressor are disclosed. The compressor includes a compressor housing; a non-orbiting scroll member and an orbiting scroll member forming a compression chamber; a discharge port for receiving a compressed fluid; and an intermediate discharge port fluidly connected between the compression chamber and the discharge port, the intermediate discharge port including a sealing member, fluid flow being prevented between the compression chamber and the discharge port through the intermediate discharge port when in a flow-blocked state, and fluid flow being enabled between the compression chamber and the discharge port through the intermediate discharge port when in a flow-permitted state.

17 Claims, 7 Drawing Sheets

(51) Int. Cl.

| | |
|---|---|
| ***F04C 28/16*** | (2006.01) |
| ***F04C 18/02*** | (2006.01) |
| ***F04C 23/00*** | (2006.01) |

(52) U.S. Cl.

CPC ..... *F25B 1/04* (2013.01); *F04C 23/008* (2013.01); *F04C 2230/85* (2013.01); *F04C 2240/10* (2013.01); *F25B 2400/13* (2013.01); *F25B 2600/0262* (2013.01)

(56) References Cited

U.S. PATENT DOCUMENTS

| | | | | |
|---|---|---|---|---|
| 2004/0101428 | A1* | 5/2004 | Shibamoto | F01C 17/06 418/55.2 |
| 2008/0138227 | A1* | 6/2008 | Knapke | F04C 18/0215 418/55.4 |
| 2009/0297379 | A1 | 12/2009 | Stover et al. | |
| 2012/0201707 | A1 | 8/2012 | Sun | |
| 2013/0089449 | A1 | 4/2013 | Seong et al. | |
| 2014/0134030 | A1* | 5/2014 | Stover | F04C 28/12 418/55.1 |
| 2015/0192121 | A1 | 7/2015 | Sung | |

OTHER PUBLICATIONS

Extended European Search Report; European Patent Application No. 16847223.1, dated May 19, 2019 (8 pages).

* cited by examiner

INTERMEDIATE DISCHARGE PORT FOR A COMPRESSOR

FIELD

This disclosure relates generally to scroll compressors. More specifically, the disclosure relates to an intermediate discharge port for a scroll compressor.

BACKGROUND

One type of compressor is generally referred to as a scroll compressor. Scroll compressors generally include a pair of scroll members which orbit relative to each other to compress air or a refrigerant. A typical scroll compressor includes a first, stationary scroll member having a base and a generally spiral wrap extending from the base and a second, orbiting scroll member having a base and a generally spiral wrap extending from the base. The spiral wraps of the first and second orbiting scroll members are interleaved, creating a series of compression chambers. The second, orbiting scroll member is driven to orbit the first, stationary scroll member by a rotating shaft. Some scroll compressors employ an eccentric pin on the rotating shaft that drives the second, orbiting scroll member.

SUMMARY

This disclosure relates generally to scroll compressors. More specifically, the disclosure relates to an intermediate discharge port for a scroll compressor.

In some embodiments, the scroll compressor can be used in a refrigeration system to compress a heat transfer fluid.

In some embodiments, an intermediate discharge port for a compressor can be included when the compressor is manufactured. In some embodiments, the intermediate discharge port for the compressor can be retrofit into a compressor that was manufactured without the intermediate discharge port.

In some embodiments, an intermediate discharge port can be added to a compressor at a location that is in fluid communication with a suction side of the compressor. In such embodiments, an incompressible fluid portion of a fluid being compressed can be forced out of a compression chamber of the compressor.

In some embodiments, a fluid flow state (e.g., flow-permitted, flow-blocked) of an intermediate discharge port of a compressor can be controlled based on a pressure differential between a discharge plenum and a compression chamber of the compressor. In such embodiments, the intermediate discharge port can be in a flow-permitted state when a pressure of the compression chamber is greater than a pressure of the discharge plenum and in a flow-blocked state when the pressure of the compression chamber is less than a pressure of the discharge plenum.

In some embodiments, the intermediate discharge port can include a sealing member having a biasing mechanism which maintains the intermediate discharge port in a flow-blocked state unless a force of the biasing mechanism is overcome (e.g., a pressure in the compression chamber is greater than a force applied by the biasing mechanism in conjunction with the pressure of the discharge plenum).

In some embodiments, the sealing member can be configured to minimize a volume between the intermediate discharge port and the compression chamber when the intermediate discharge port is in the flow-blocked state.

In some embodiments, a plurality of intermediate discharge ports can be included in a compressor.

An intermediate discharge port in a scroll compressor and a method for controlling part-load efficiency of a scroll compressor are disclosed. The compressor includes a compressor housing; a non-orbiting scroll member and an orbiting scroll member forming a compression chamber; a discharge port for receiving a compressed fluid; and an intermediate discharge port fluidly connected between the compression chamber and the discharge port, the intermediate discharge port including a sealing member, fluid flow being prevented between the compression chamber and the discharge port through the intermediate discharge port when in a flow-blocked state, and fluid flow being enabled between the compression chamber and the discharge port through the intermediate discharge port when in a flow-permitted state.

A heat transfer circuit is described. The heat transfer circuit includes a compressor, a condenser, an expansion device, and an evaporator fluidly connected. The compressor includes a compressor housing; a non-orbiting scroll member and an orbiting scroll member forming a compression chamber; a discharge port for receiving a compressed fluid; and an intermediate discharge port fluidly connected between the compression chamber and the discharge port, the intermediate discharge port including a sealing member, fluid flow being prevented between the compression chamber and the discharge port through the intermediate discharge port when in a flow-blocked state, and fluid flow being enabled between the compression chamber and the discharge port through the intermediate discharge port when in a flow-permitted state.

A method is described. The method includes providing an intermediate discharge port at a location in fluid communication with a compression chamber of a scroll compressor, the location being such that when operating the compressor at part-load, a portion of a fluid being compressed is directed from the compression chamber toward a discharge plenum of the scroll compressor and is at a pressure that is lower than a discharge pressure of the compressor when operating at full-load, and when operating the compressor at full-load, the portion of the fluid being compressed remains in the compression chamber until reaching a discharge location of the compression chamber.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTION

This disclosure relates generally to scroll compressors. More specifically, the disclosure relates to an intermediate discharge port for a scroll compressor.

Figure 1:
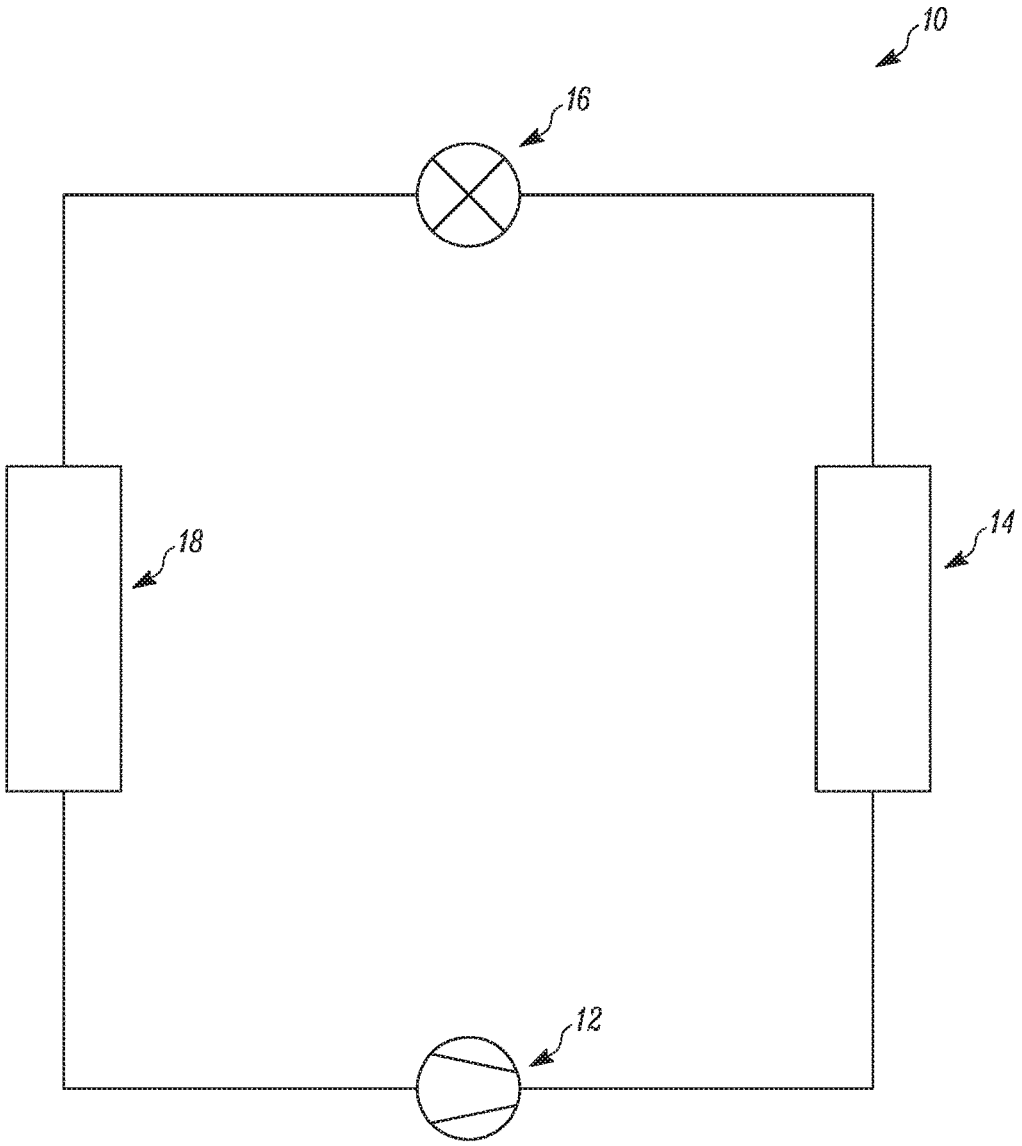
FIG. 1 is a schematic diagram of a heat transfer circuit, according to some embodiments.

FIG. 1 is a schematic diagram of a heat transfer circuit 10, according to some embodiments. The heat transfer circuit 10 generally includes a compressor 12, a condenser 14, an expansion device 16, and an evaporator 18. The compressor 12 can be, for example, a scroll compressor such as the scroll compressors shown and described in accordance with FIGS. 2-6 below. The heat transfer circuit 10 is exemplary and can be modified to include additional components. For example, in some embodiments the heat transfer circuit 10 can include other components such as, but not limited to, an economizer heat exchanger, one or more flow control devices, a receiver tank, a dryer, a suction-liquid heat exchanger, or the like.

The heat transfer circuit 10 can generally be applied in a variety of systems used to control an environmental condition (e.g., temperature, humidity, air quality, or the like) in a space (generally referred to as a conditioned space). Examples of systems include, but are not limited to, heating, ventilation, and air conditioning (HVAC) systems, transport refrigeration systems, or the like.

The components of the heat transfer circuit 10 are fluidly connected. The heat transfer circuit 10 can be specifically configured to be a cooling system (e.g., an air conditioning system) capable of operating in a cooling mode. Alternatively, the heat transfer circuit 10 can be specifically configured to be a heat pump system which can operate in both a cooling mode and a heating/defrost mode.

Heat transfer circuit 10 operates according to generally known principles. The heat transfer circuit 10 can be configured to heat or cool a heat transfer fluid or medium (e.g., a liquid such as, but not limited to, water or the like), in which case the heat transfer circuit 10 may be generally representative of a liquid chiller system. The heat transfer circuit 10 can alternatively be configured to heat or cool a heat transfer medium or fluid (e.g., a gas such as, but not limited to, air or the like), in which case the heat transfer circuit 10 may be generally representative of an air conditioner or heat pump.

In operation, the compressor 12 compresses a heat transfer fluid (e.g., refrigerant or the like) from a relatively lower pressure gas to a relatively higher-pressure gas. The relatively higher-pressure and higher temperature gas is discharged from the compressor 12 and flows through the condenser 14. In accordance with generally known principles, the heat transfer fluid flows through the condenser 10 and rejects heat to a heat transfer fluid or medium (e.g., water, air, etc.), thereby cooling the heat transfer fluid. The cooled heat transfer fluid, which is now in a liquid form, flows to the expansion device 16. The expansion device 16 reduces the pressure of the heat transfer fluid. As a result, a portion of the heat transfer fluid is converted to a gaseous form. The heat transfer fluid, which is now in a mixed liquid and gaseous form flows to the evaporator 18. The heat transfer fluid flows through the evaporator 18 and absorbs heat from a heat transfer medium (e.g., water, air, etc.), heating the heat transfer fluid, and converting it to a gaseous form. The gaseous heat transfer fluid then returns to the compressor 12. The above-described process continues while the heat transfer circuit is operating, for example, in a cooling mode (e.g., while the compressor 12 is enabled).

Figure 2:
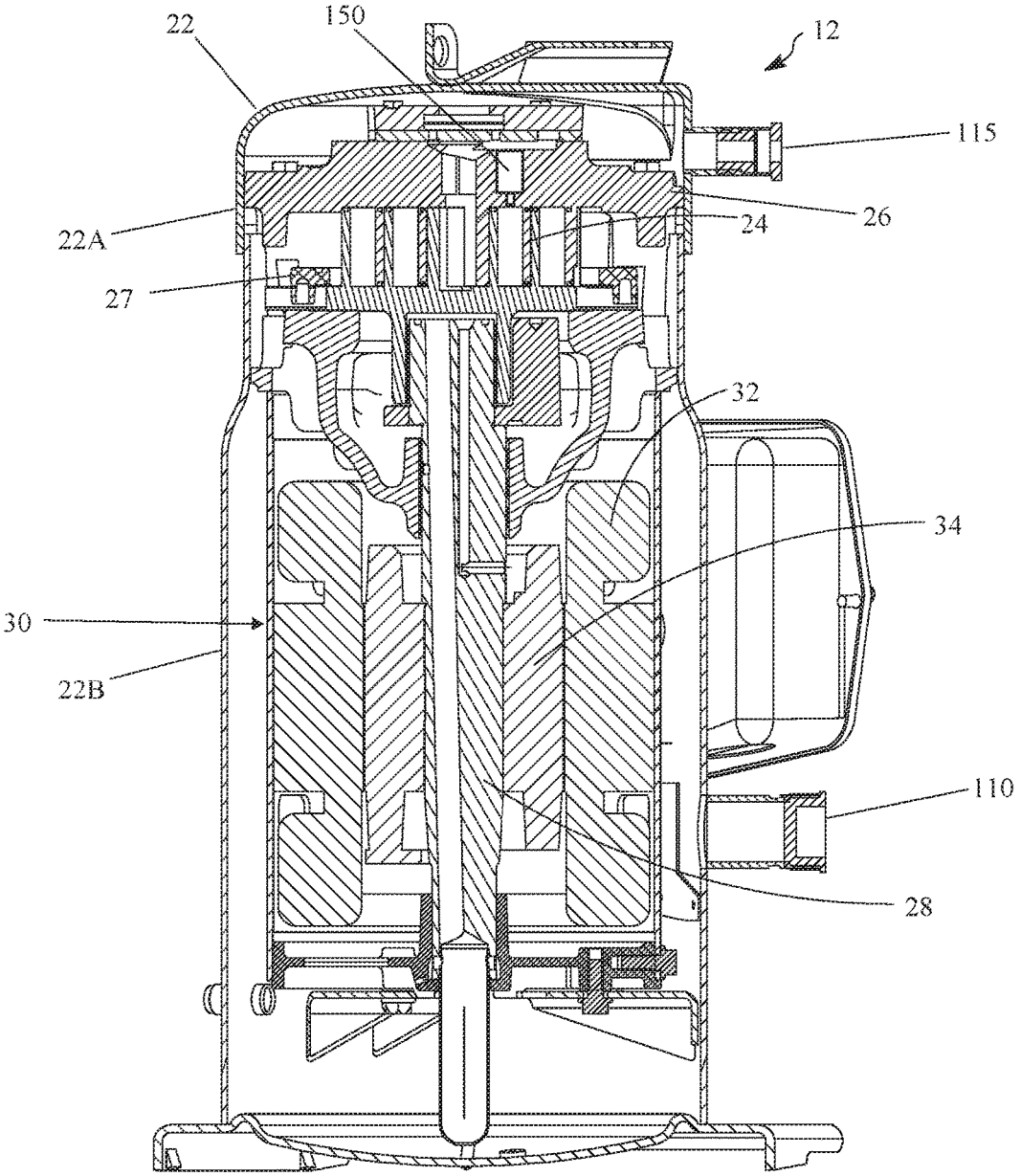
FIG. 2 illustrates a sectional view of a compressor with which embodiments disclosed in this specification can be practiced, according to some embodiments.

FIG. 2 illustrates a sectional view of the compressor 12 with which embodiments as disclosed in this specification can be practiced, according to some embodiments. The compressor 12 can be used in the heat transfer circuit 10 of FIG. 1. It is to be appreciated that the compressor 12 can also be used for purposes other than in a heat transfer circuit. For example, the compressor 12 can be used to compress air or gases other than a heat transfer fluid (e.g., natural gas, etc.). It is to be appreciated that the scroll compressor 12 includes additional features that are not described in detail in this specification. For example, the scroll compressor 12 includes a lubricant sump for storing lubricant to be introduced to the moving features of the scroll compressor 12.

The illustrated compressor 12 is a single-stage scroll compressor. More specifically, the illustrated compressor 12 is a single-stage vertical scroll compressor. It is to be appreciated that the principles described in this specification are not intended to be limited to single-stage scroll compressors and that they can be applied to multi-stage scroll compressors having two or more compression stages. Generally, the embodiments as disclosed in this specification are suitable for a compressor with a vertical or a near vertical crankshaft (e.g., crankshaft 28). It is to be appreciated that the embodiments may also be applied to a horizontal compressor.

The compressor 12 is illustrated in sectional side view. The scroll compressor 12 includes an enclosure 22. The enclosure 22 includes an upper portion 22A and a lower portion 22B. The compressor 12 includes a suction inlet 110 and a discharge outlet 115.

The compressor 12 includes an orbiting scroll 24 and a non-orbiting scroll 26. The non-orbiting scroll 26 can alternatively be referred to as, for example, the stationary scroll 26, the fixed scroll 26, or the like. The non-orbiting scroll 26 is aligned in meshing engagement with the orbiting scroll 24 by means of an Oldham coupling 27.

The compressor 12 includes a driveshaft 28. The driveshaft 28 can alternatively be referred to as the crankshaft 28. The driveshaft 28 can be rotatably driven by, for example, an electric motor 30. The electric motor 30 can generally include a stator 32 and a rotor 34. The driveshaft 28 is fixed to the rotor 34 such that the driveshaft 28 rotates along with the rotation of the rotor 34. The electric motor 30, stator 32, and rotor 34 operate according to generally known principles. The driveshaft 28 can, for example, be fixed to the rotor 34 via an interference fit or the like. The driveshaft 28 can, in some embodiments, be connected to an external electric motor, an internal combustion engine (e.g., a diesel engine or a gasoline engine), or the like. It will be appreciated that in such embodiments the electric motor 30, stator 32, and rotor 34 would not be present in the compressor 12.

The compressor 12 can include an intermediate discharge port 150. The intermediate discharge port 150 can, for example, provide an exit flow path for a fluid being compressed (e.g., heat transfer fluid such as, for example, refrigerant, etc.). The exit flow path can, for example, enable fluid to exit a compression pocket prior to being discharged from a standard discharge port (e.g., discharge port 175 as shown and described in accordance with FIGS. 3A-3B below) of the compressor 12. The intermediate discharge port 150 can prevent overcompression of the fluid being compressed. In some embodiments, preventing overcompression of the fluid can increase an efficiency of the compressor 12. The intermediate discharge port 150 is shown and described in additional detail in accordance with FIGS. 3-6 below. In some embodiments, the intermediate discharge port 150 can be included in the compressor 12 at a time of manufacturing. In some embodiments, the intermediate discharge port 150 can be retrofitted into a scroll compressor after manufacturing, and in some embodiments, even after the scroll compressor has been in use.

Figure 3A:
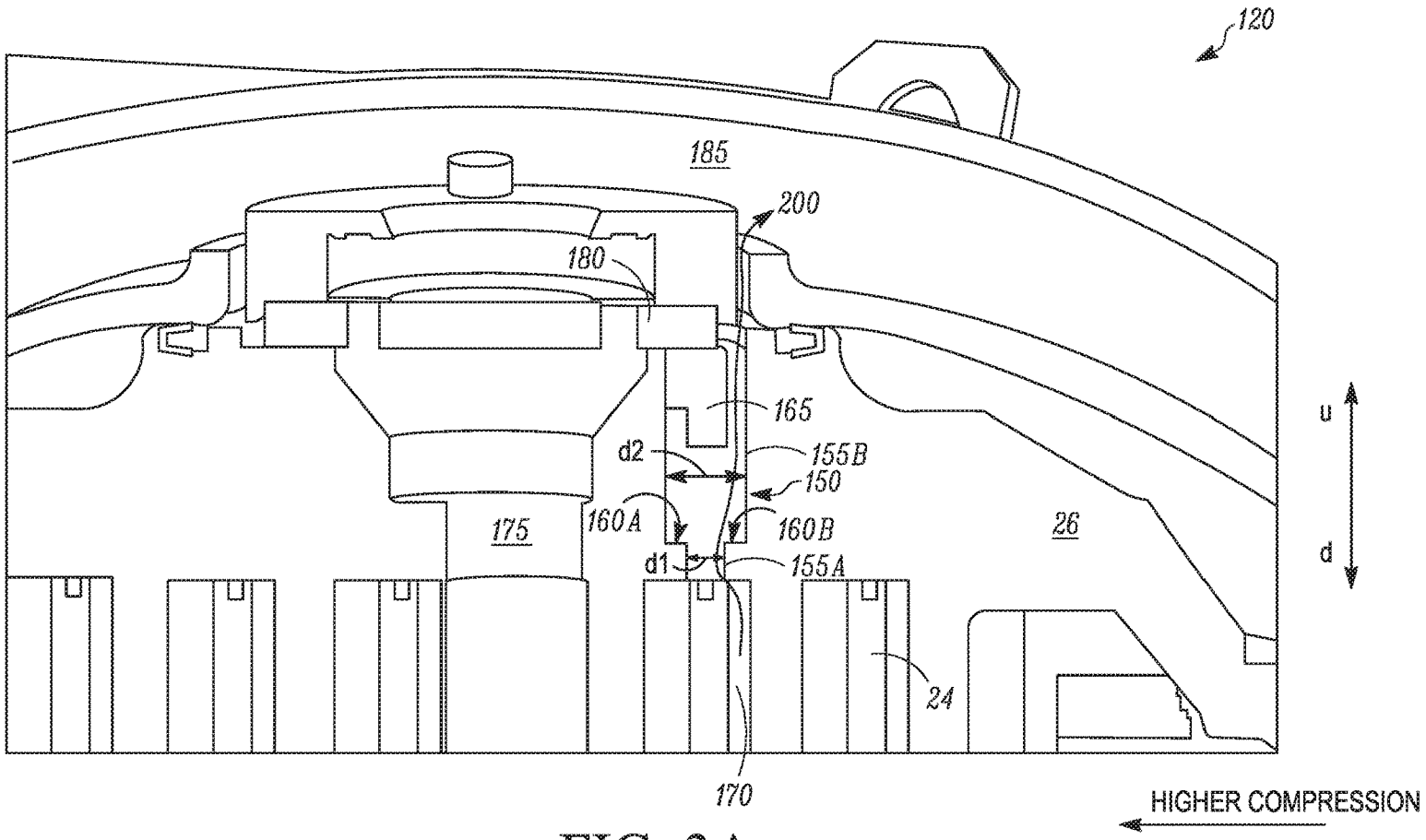
FIGS. 3A-3B illustrate a portion of a scroll compressor including an intermediate discharge port, according to some embodiments.
Figure 3B:
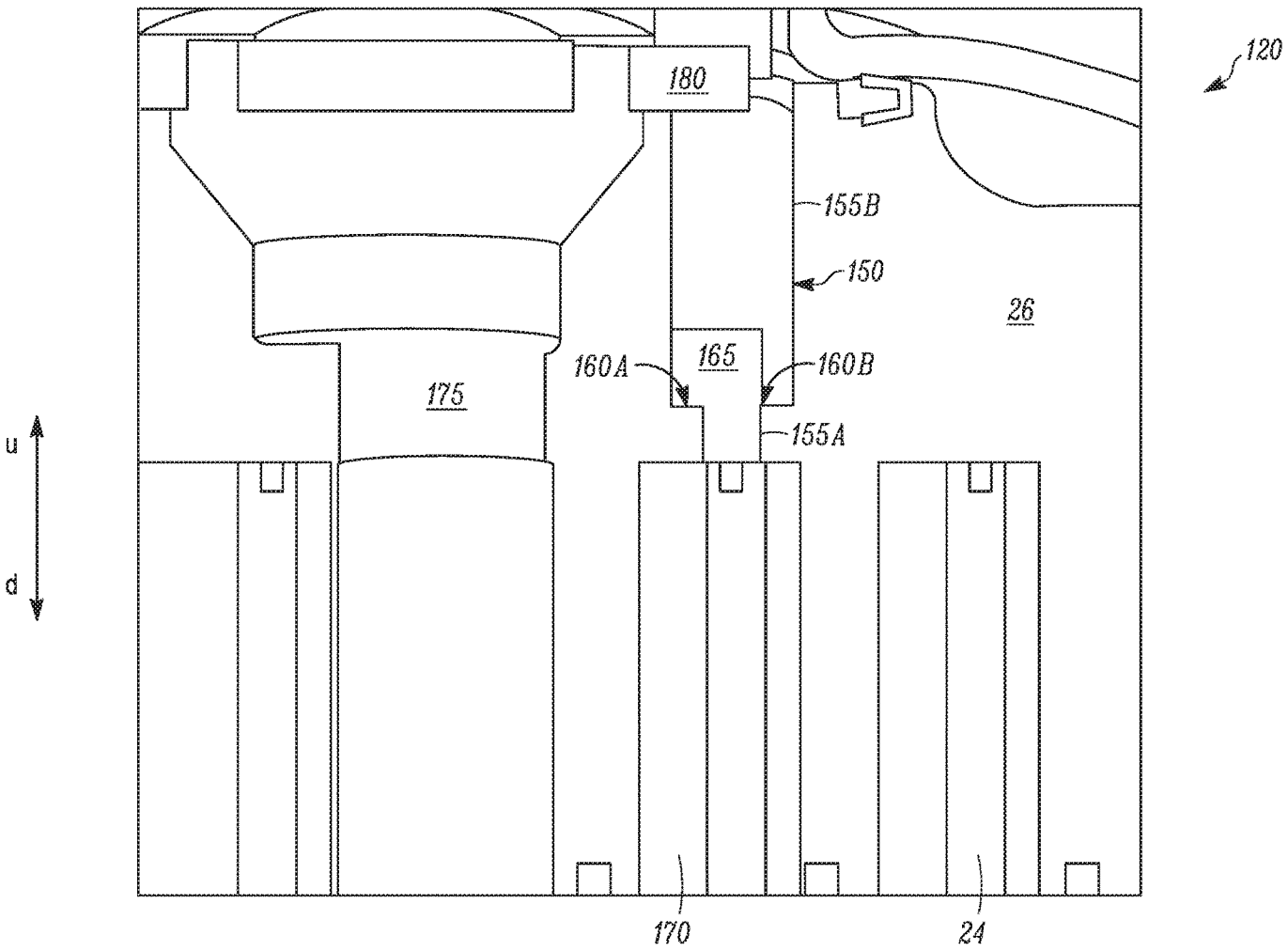

FIGS. 3A-3B illustrate a portion of a compressor 120 (i.e., close up views shown within a rectangular border), according to some embodiments. Aspects of the compressor 120 can be the same as or similar to aspects of the compressor 12. For simplicity of this specification, features previously described will not be described in further detail. The compressor 120 can be used as the compressor 12 in the heat transfer circuit 10 of FIG. 1.

In FIG. 3A, the intermediate discharge port 150 is illustrated in a flow-permitted state. In FIG. 3B, the intermediate discharge port 150 is illustrated in a flow-blocked state. The features of FIGS. 3A-3B will be discussed generally, while specific references to either figure are made. The compressor 120 includes the intermediate discharge port 150. As illustrated, a sealing member 165 in the intermediate discharge port 150 is in a flow-permitted state. The sealing member 165 can be moved between the flow-permitted state and the flow-blocked state by traveling in either a direction u or a direction d. The sealing member 165 can, for example, function similarly to a poppet valve in some embodiments.

The illustrated embodiment of the compressor 120 includes a single intermediate discharge port 150. The compressor 120 can include a plurality of intermediate discharge ports 150. In some embodiments, a plurality of intermediate discharge ports 150 can provide additional increases in efficiency of the compressor 120 relative to a single intermediate discharge port 150. The compressor 120 can be configured to include intermediate discharge ports 150 that are symmetrically disposed (as viewed in the figures) with respect to a discharge port 175. That is, another intermediate discharge port 150 can be included on a left side (as viewed in the figures) of the compressor 120 at a location (in a left-right direction representing a relative location within the compression chamber 170) that is at or about the same as the location of the intermediate discharge port 150. In some embodiments an additional intermediate discharge port 150 disposed on the left side (as viewed in the figures) of the discharge port 175 of the compressor 120 could be at a different location (in the left-right direction) than the intermediate discharge port 150. For example, the intermediate discharge ports 150 could be disposed asymmetrically on either side of a discharge port 175 of the compressor 120. In some embodiments, another intermediate discharge port 150 can be included on the right side (as viewed in the figures) of the discharge port 175 of the compressor 120 and one or more additional intermediate discharge ports 150 can be included on the left side (as viewed in the figures) of the compressor 120. In general, a location in the left-right direction of the figures represents a selected location within the compression chamber 170 of the compressor 120.

The intermediate discharge port 150 includes a first portion 155A and a second portion 155B. The first portion 155A is in fluid communication with an intermediate chamber 170 of the compressor 120. The first portion 155A has a diameter d1 and the second portion 155B has a diameter d2. In some embodiments, the diameter d1 is relatively smaller than the diameter d2. The first portion 155A and the second portion 155B can generally be cylindrical, subject to, for example, manufacturing processes and tolerances. In some embodiments, this may simplify the manufacturing process. For example, a stepped drill bit or the like may simplify the process of forming the intermediate discharge port 150. It is to be appreciated that geometries for the first and second portions 155A, 155B can vary. Different geometries for the first and second portions 155A, 155B can be selected that operate according to the principles described in this specification. The particular geometry of the embodiments described is not intended to be limiting, other geometries may be considered, for example, with respect to flow optimization, efficiency maximization, and manufacturing time and/or costs. In some embodiments, the diameter d2 may be selected such that a plurality of intermediate discharge ports 150 can be included in the compressor 120 with a relatively limited clearance required between each intermediate discharge port 150.

A difference in dimensions d1, d2 of the first and second portions 155A, 155B creates first and second surfaces 160A, 160B (respectively). The first and second surfaces 160A, 160B can serve as sealing surfaces (e.g., a valve seat) with which the sealing member 165 forms a sealing engagement when the intermediate discharge port 150 is in the flow-blocked state (as shown in FIG. 3B). It will be appreciated that the first and second surfaces 160A, 160B are illustrated as being two separate surfaces when viewed in a cross section, but that the first and second surfaces 160A, 160B can generally be a single, continuous surface in a ring-shape, subject to, for example, manufacturing processes and tolerances. The sealing member 165 can be configured such that a portion of the sealing member 165 fits into the first portion 155A similar to a plug.

In some embodiments, the first and second surfaces 160A, 160B may not provide a sealing engagement with the sealing member 165. In such embodiments, the surfaces 160A, 160B may provide a stop to prevent the sealing member 165 from protruding into the compression chamber 170 (in the direction d) and interfering with the orbiting scroll 24 as it moves when the compressor 120 is in operation. In some embodiments, the sealing member 165 can extend such that it is at or about flush with the compression chamber 170. Advantageously, in some embodiments, this can reduce a volumetric increase of the compression chamber 170 when the intermediate discharge port 150 is in the flow-blocked state. In some embodiments, this can prevent compressed fluid from entering the intermediate discharge port 150 even when the intermediate discharge port 150 is in the flow-blocked state. In such embodiments, the sealing engagement can be a result of a portion of the sealing member 165 (e.g., reduced diameter portion 165E of the sealing member 165 as shown and described in accordance with FIG. 6 below). The portion of the sealing member 165 can function similar to a plug in such embodiments. That is, the sealing engagement may be achieved by having the diameter of the sealing member 165 be about the same as the diameter d1 in order to minimize any gap between the sealing member 165 in the first portion 155A. In some embodiments, a sealing member such as, but not limited to, labyrinth sealing rings (e.g., annular rings, saw teeth, etc.) on the portion of the sealing member 165 that is disposed within the first portion 155A can be included to reduce leakage when the sealing member 165 is in the flow-blocked state.

In FIG. 3A, the intermediate discharge port 150 is in a flow-permitted state. In the flow-permitted state, the sealing member 165 is displaced vertically away (in a direction u) from the first portion 155A of the intermediate discharge port 150. In the flow-permitted state, a surface of the sealing member 165 is in contact with the retaining member 180. The retaining member 180 covers a portion of the second portion 155B of the intermediate discharge port 150. The uncovered portion of the second portion 155B permits fluid from the compression chamber 170 to flow into a discharge plenum 185.

As shown in FIG. 3B, when the intermediate discharge port 150 is in the flow-blocked state, the sealing member 165 is disposed such that the sealing member 165 is in sealing engagement with the first and second surfaces 160A, 160B such that flow from the compression chamber 170 through the intermediate discharge port and into the discharge plenum 185 is prevented. As discussed above with respect to FIG. 3A, in the flow-blocked state, the first and second surfaces 160A, 160B may not provide a sealing engagement with the sealing member 165. In such embodiments, the surfaces 160A, 160B may just provide a stop to prevent the sealing member 165 from protruding (in the direction d) into the compression chamber 170 and interfering with the orbiting scroll 24 as it moves when the compressor 120 is in operation. In such embodiments, the sealing engagement can be a result of a portion of the sealing member 165 (e.g., reduced diameter portion 165E of the sealing member 165 as shown and described in accordance with FIG. 6 below). That is, the sealing engagement may be achieved by having the diameter of the sealing member 165 be about the same as the diameter d1 in order to minimize any gap between the sealing member 165 in the first portion 155A. In some embodiments, a sealing member such as, but not limited to, labyrinth sealing rings (e.g., annular rings, saw teeth, etc.) on the portion of the sealing member 165 that is disposed within the first portion 155A can be included to reduce leakage when the sealing member 165 is in the flow-blocked state.

In operation, the intermediate discharge port 150 can alternate between the flow-permitted and flow-blocked states based on pressure ratios in the discharge plenum 185 and the compression chamber 170. When the compressor 120 is operating at a lower pressure ratio than designed (e.g., part-load operation), the intermediate discharge port 150 is in the flow-permitted state (FIG. 3A). In such an operating condition, the pressure in the discharge plenum 185 is lower than the pressure in the compression chamber 170. Accordingly, the pressurized fluid forces the sealing member 165 vertically upward (in the u direction), enabling flow (as shown by 200) from the compression chamber 170, through the intermediate discharge port 150, and into the discharge plenum 185. When the compressor 120 is operating at its designed pressure ratio (e.g., full-load operation), the pressure of the fluid in the discharge plenum 185 is higher than the pressure of the fluid in the compression chamber 170. As a result, the sealing member 165 is forced vertically downward (in a direction d), thereby causing the sealing member 165 to be in sealing contact with the first and second surfaces 160A, 160B, which prevents flow through the intermediate discharge port 150. In such an operating condition, the fluid being compressed is discharged through the standard discharge port 175.

In some embodiments, the intermediate discharge port 150 can additionally include a biasing mechanism (e.g., a spring or the like) to determine whether the intermediate discharge port 150 is in the flow-permitted or the flow-blocked state. Such an embodiment may be similar to the embodiment shown and described in accordance with FIG. 4 below. In such embodiments, the biasing mechanism provides a force to maintain the intermediate discharge port 150 in a flow-blocked state unless the pressure in the compression chamber 170 is sufficient to overcome the force provided by the biasing mechanism along with a pressure force from the fluid in the discharge plenum 185.

Figure 4:
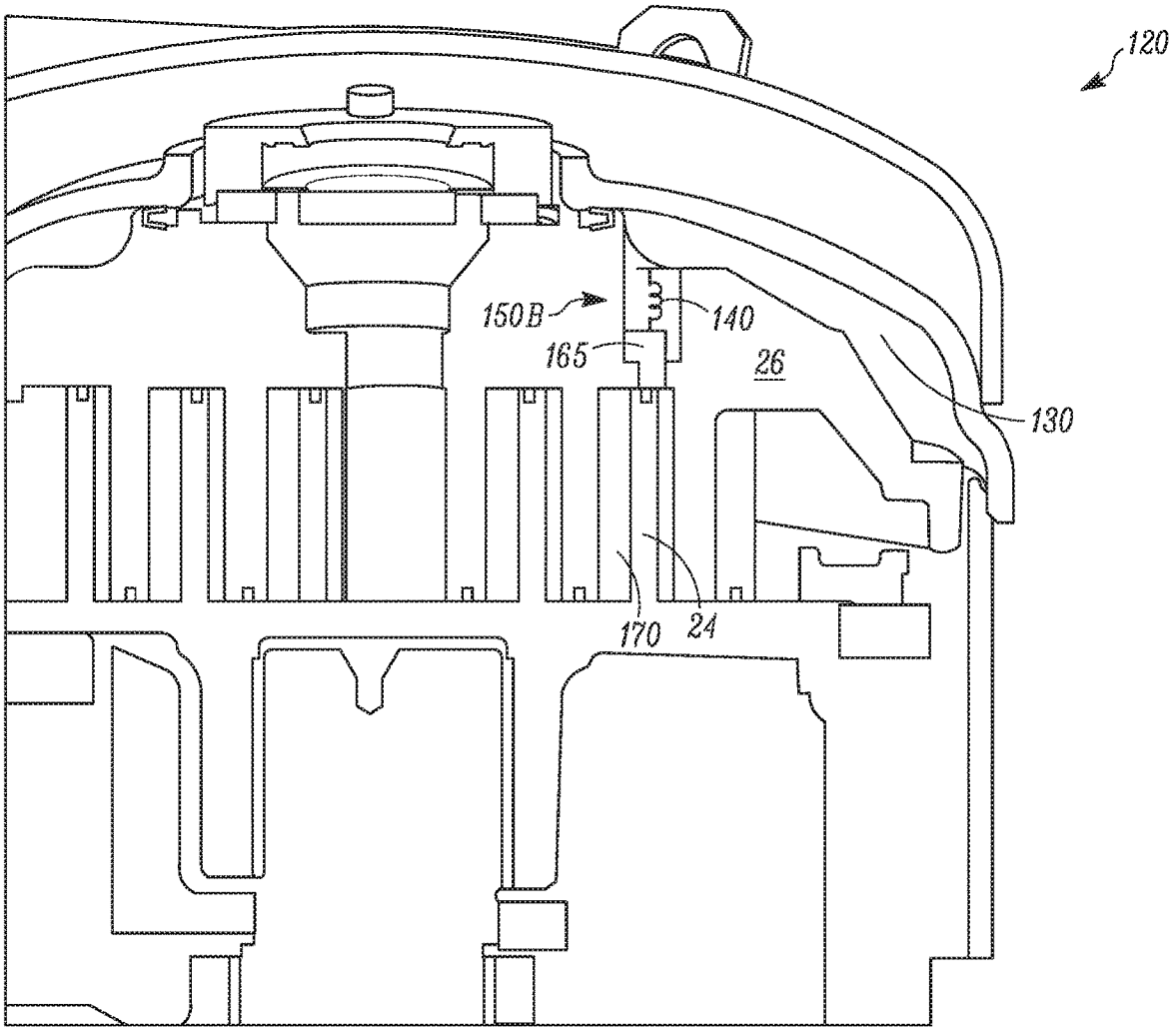
FIG. 4 illustrates a portion of a scroll compressor including an intermediate discharge port, according to other embodiments.

FIG. 4 illustrates the portion of a compressor 120 (i.e., a close up view shown within a rectangular border), according to other embodiments. Aspects of the compressor 120 can be the same as or similar to aspects of the compressor 12. For simplicity of this specification, features previously described will not be described in further detail. The compressor 120 can be used as the compressor 12 in the heat transfer circuit 10 of FIG. 1.

The compressor 120 includes an intermediate discharge port 150B. Aspects of the intermediate discharge port 150B can be the same as or similar to aspects of the intermediate discharge port 150 as shown and described in accordance with FIGS. 3A-3B. In general, the intermediate discharge port 150B is disposed in a different location of the compression cycle of the compressor 120. Further, the intermediate discharge port 150B is disposed in fluid communication with a suction side 130 of the compressor 120. Accordingly, if, for example, a portion of fluid which is in a liquid form enters the compression chamber, the liquid can be forced out the intermediate discharge port 150B and returned to the suction side 130. As a result, incompressible liquid can be removed from the compression chamber 170 of the compressor 120. This can, in some embodiments, increase a lifetime of the compressor 120 by, for example, reducing stresses on scroll members 24, 26 of the compressor 120.

The intermediate discharge port 150B operates similarly to the intermediate discharge port 150. However, a biasing mechanism 140 is included to maintain the intermediate discharge port 150B in the flow-blocked state unless an incompressible liquid is forced out of the compression chamber 170 into the intermediate discharge port 150B. The biasing mechanism 140 can be, for example, a spring or the like. The biasing mechanism 140 may be included because the suction side 130 of the compressor 120 is at a lower pressure than the compression chamber 170. Accordingly, the biasing mechanism 140 can be selected with a stiffness sufficient to keep the intermediate discharge port 150B in the flow-blocked state unless the pressure in the compression chamber 170 is over a threshold pressure, in which case the pressure would overcome the force of the biasing mechanism 140 and fluid would be permitted to flow through the intermediate discharge port 150B.

In some embodiments, one or more additional intermediate discharge ports 150 can be included along with the intermediate discharge port 150B. That is, in some embodiments, the compressor 120 can include the intermediate discharge port 150 as shown and described in accordance with FIGS. 3A-3B as well as the intermediate discharge port 150B.

Figure 5:
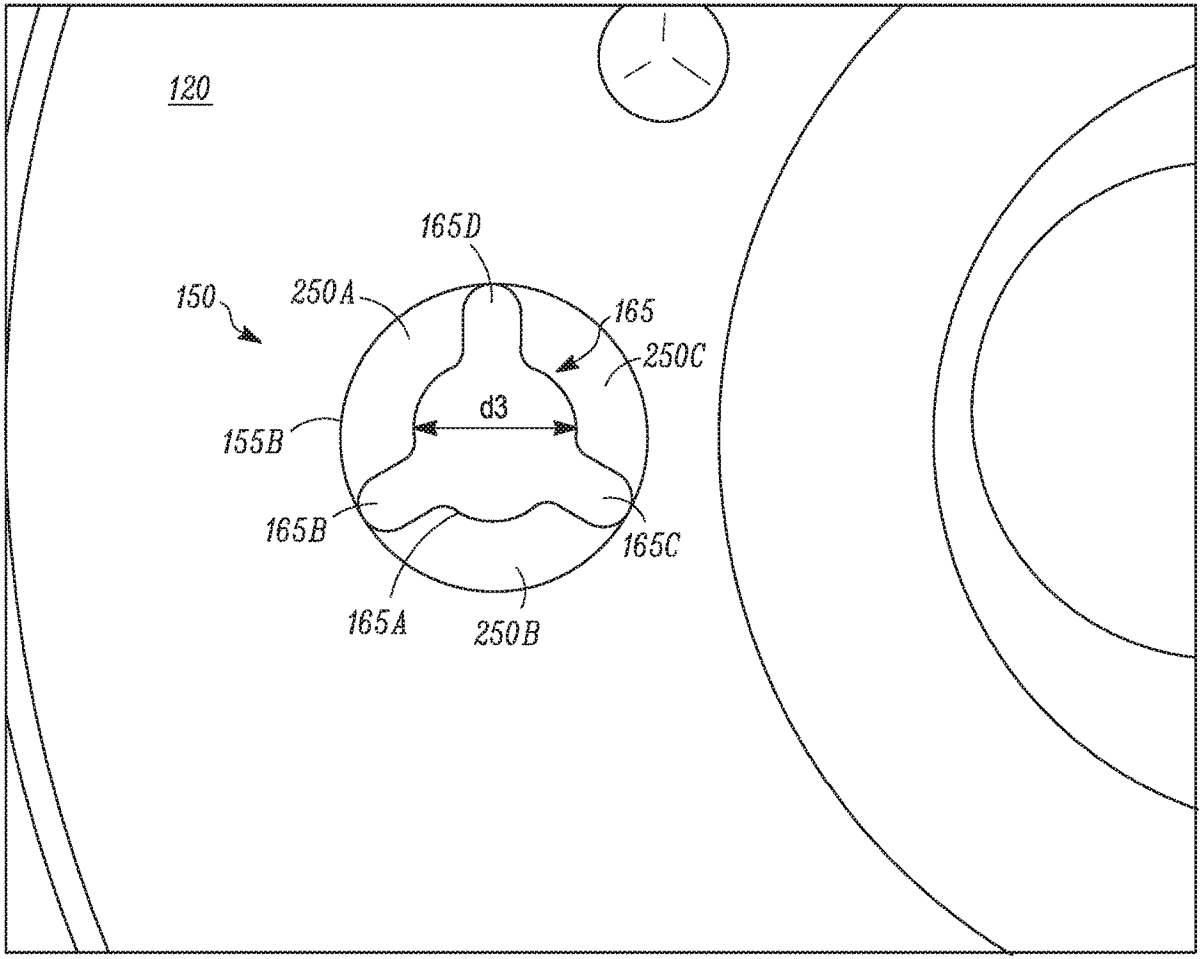
FIG. 5 illustrates a flow control device installed in a scroll compressor, according to some embodiments.

FIG. 5 illustrates a top view of the intermediate discharge port 150 installed in the compressor 120 (i.e., a close up view shown within a rectangular border), according to some embodiments. It will be appreciated that the sealing member 165 as shown can also be used in the intermediate discharge port 150B. The intermediate discharge port 150 includes the sealing member 165 installed in the second portion 155B. The sealing member 165 can be in the flow-permitted or the flow-blocked state.

The sealing member 165 includes a center portion 165A that is generally cylindrical, subject to, for example, manufacturing processes and tolerances, in the illustrated embodiment. A plurality of protrusions 165B-165D extend from the center portion 165A. The sealing member 165 in the illustrated embodiment includes three protrusions 165B-165D. It will be appreciated that the number of protrusions can be varied. The protrusions 165B-165D are included in order to prevent the sealing member 165 from becoming misaligned within the second portion 155B of the intermediate discharge port 150, particularly as the sealing member 165 is moved between the flow-blocked and flow-permitted states. In some embodiments, the protrusions 165B-165D can prevent the sealing member 165 from inadvertently entering the compression chamber 170 (FIGS. 3A-3B). More specifically, the protrusions 165B-165D can be included to ensure that the sealing member 165 can provide a sealing engagement with the first and second surfaces 160A, 160B.

The center portion 165A has a diameter d3 which is larger than the diameter d1 of the first portion 155A but is smaller than the diameter d2 of the second portion 155B of the intermediate discharge port 150. As a result, a portion of the sealing member 165 can contact the first and second surfaces 160A, 160B to provide a seal (e.g., flow-blocked state). Three flow passages 250A-250C are formed between the protrusions 165B-165D through which fluid can flow when the intermediate discharge port 150 is in the flow-permitted state. The sealing member 165 can be made of a variety of materials such as, but not limited to, metals, plastics, or the like. In some embodiments, a biasing mechanism (e.g., biasing mechanism 140 of FIG. 4) can be securely fixed to the sealing member 165 (e.g., partially over-molded spring in plastic, etc.). In some embodiments, the biasing mechanism can be constrained between a retaining member (e.g., retaining member 180 of FIG. 3A) and the sealing member 165.

Figure 6:
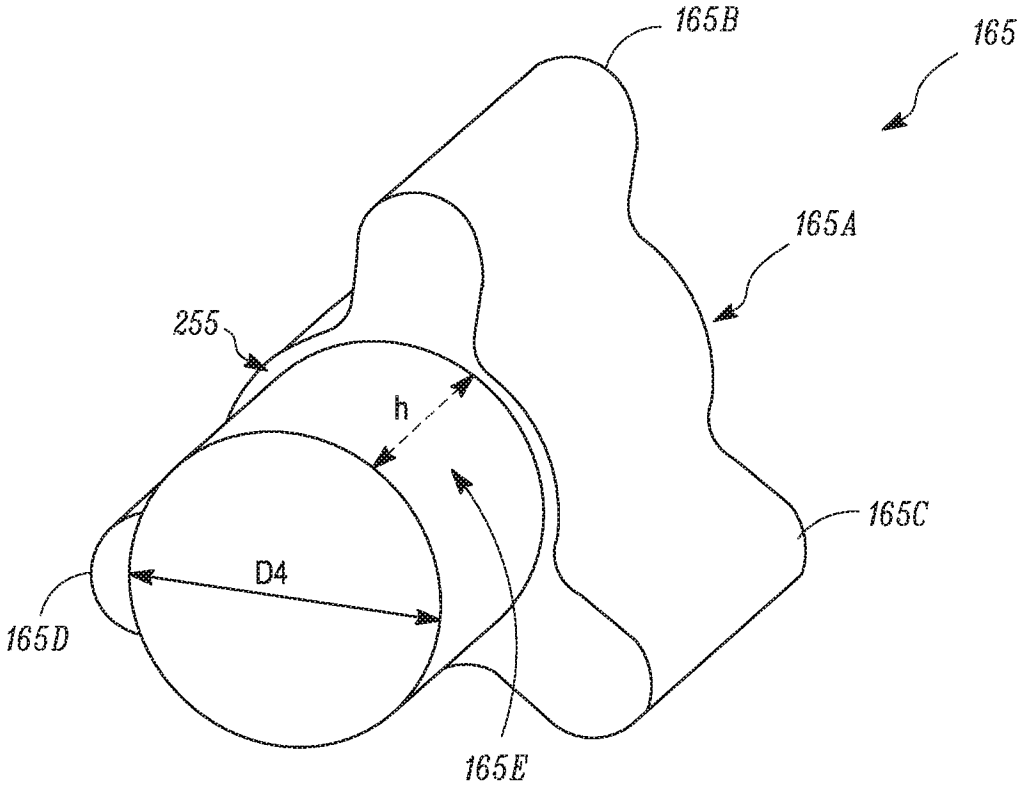
FIG. 6 illustrates the flow control device of FIG. 5, according to some embodiments.

FIG. 6 illustrates the sealing member 165 of FIG. 5, according to some embodiments. The sealing member 165 includes the center portion 165A, protrusions 165B-165D, and a reduced diameter portion 165E. The reduced diameter portion 165E has a diameter d4 which is smaller than the diameter d3 (FIG. 5) of the center portion 165A. In some embodiments, the diameter d4 is at or about the same as the diameter d1 of the first portion 155A of the intermediate discharge port 150. In some embodiments, the diameter d4 is smaller than the diameter d1 of the first portion 155A of the intermediate discharge port 150. Accordingly, the reduced diameter portion 165E can be inserted into the first portion 155A of the intermediate discharge port 150 when in a flow-blocked state. The reduced diameter portion 165E has a height h, which is substantially similar to a depth of the first portion 155A, subject to, for example, manufacturing processes and tolerances, such that the sealing member 165 does not extend into the compression chamber 170 of the compressor 120 when the intermediate discharge port 150 is in the flow-blocked state. The height h being substantially similar to the depth of the first portion 155A, subject to, for example, manufacturing processes and tolerances, can also reduce a volumetric expansion of the compression chamber 170 of the compressor 120. Reducing the volumetric expansion of the compression chamber 170 can prevent compressed fluid from leaving the compression chamber 170 and entering a portion of the intermediate discharge port 150 even when the intermediate discharge port 150 is in the flow-blocked state. Because of the reduced diameter d4 of the reduced diameter portion 165E (relative to the center portion 165A having a diameter d3), a surface 255 is formed which can sealingly engage with the first and second surfaces 160A, 160B in order to provide a sealing engagement between the sealing member 165 and the first and second surfaces 160A, 160B.

Aspects:

It is to be appreciated that any one of aspects 1-7 can be combined with any one of aspects 8-14 or 15-16. Any one of aspects 8-14 can be combined with any one of aspects 15-16.

Aspect 1. A compressor, comprising:

a compressor housing;

a non-orbiting scroll member and an orbiting scroll member forming a compression chamber;

a discharge port for receiving a compressed fluid; and an intermediate discharge port fluidly connected between the compression chamber and the discharge port, the intermediate discharge port including a sealing member, fluid flow being prevented between the compression chamber and the discharge port through the intermediate discharge port when in a flow-blocked state, and fluid flow being enabled between the compression chamber and the discharge port through the intermediate discharge port when in a flow-permitted state.

Aspect 2. The compressor according to aspect 1, wherein the intermediate discharge port is disposed at a location of the compression chamber at which a fluid being compressed is partially compressed.

Aspect 3. The compressor according to any one of aspects 1-2, wherein the compressor includes a plurality of intermediate discharge ports.

Aspect 4. The compressor according to any one of aspects 1-3, wherein the intermediate discharge port includes a biasing mechanism for maintaining the sealing member in the flow-blocked state.

Aspect 5. The compressor according to any one of aspects 1-4, wherein the sealing member includes a center portion having a first diameter and a plurality of protrusions.

Aspect 6. The compressor according to aspect 5, wherein the sealing member further includes a reduced diameter portion having a second diameter smaller than the first diameter, thereby forming a sealing edge on a surface of the center portion.

Aspect 7. The compressor according to aspect 6, wherein in the flow-blocked state, the sealing edge of the sealing member is sealingly engaged with a surface of the intermediate discharge port.

Aspect 8. A heat transfer circuit, comprising:

a compressor, a condenser, an expansion device, and an evaporator fluidly connected, wherein the compressor includes:

a compressor housing;

a non-orbiting scroll member and an orbiting scroll member forming a compression chamber;

a discharge port for receiving a compressed fluid; and an intermediate discharge port fluidly connected between the compression chamber and the discharge port, the intermediate discharge port including a sealing member, fluid flow being prevented between the compression chamber and the discharge port through the intermediate discharge port when in a flow-blocked state, and fluid flow being enabled between the compression chamber and the discharge port through the intermediate discharge port when in a flow-permitted state.

Aspect 9. The heat transfer circuit according to aspect 8, wherein the intermediate discharge port is disposed at a location of the compression chamber at which a fluid being compressed is partially compressed.

Aspect 10. The heat transfer circuit according to any one of aspects 8-9, wherein the compressor includes a plurality of intermediate discharge ports.

Aspect 11. The heat transfer circuit according to any one of aspects 8-10, wherein the intermediate discharge port includes a biasing mechanism for maintaining the sealing member in the flow-blocked state.

Aspect 12. The heat transfer circuit according to any one of aspects 8-11, wherein the sealing member includes a center portion having a first diameter and a plurality of protrusions.

Aspect 13. The heat transfer circuit according to aspect 12, wherein the sealing member further includes a reduced diameter portion having a second diameter smaller than the first diameter, thereby forming a sealing edge on a surface of the center portion.

Aspect 14. The heat transfer circuit according to aspect 13, wherein in the flow-blocked state, the sealing edge of the sealing member is sealingly engaged with a surface of the intermediate discharge port.

Aspect 15. A method, comprising:

providing an intermediate discharge port at a location in fluid communication with a compression chamber of a scroll compressor, the location being such that when operating the compressor at part-load, a portion of a fluid being compressed is directed from the compression chamber toward a discharge plenum of the scroll compressor and is at a pressure that is lower than a discharge pressure of the compressor when operating at full-load, and when operating the compressor at full-load, the portion of the fluid being compressed remains in the compression chamber until reaching a discharge location of the compression chamber.

Aspect 16. The method according to aspect 15, wherein the providing includes retrofitting the intermediate discharge port into the scroll compressor following manufacturing.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts, without departing from the scope of the present disclosure. The word "embodiment" as used within this specification may, but does not necessarily, refer to the same embodiment. This specification and the embodiments described are examples only. Other and further embodiments may be devised without departing from the basic scope thereof, with the true scope and spirit of the disclosure being indicated by the claims that follow.

What is claimed is:

1. A compressor, comprising:

a compressor housing;

a non-orbiting scroll member and an orbiting scroll member forming a compression chamber;

a discharge port for receiving a compressed fluid; and an intermediate discharge port fluidly connected between the compression chamber and the discharge port, the intermediate discharge port including:

a first portion having a first diameter, the first portion disposed adjacent the compression chamber, a second portion having a second diameter different from the first diameter, the second portion disposed adjacent the first portion and adjacent the discharge port, a sealing member disposed within the intermediate discharge port, wherein the sealing member includes a center portion having a diameter and a plurality of protrusions, fluid flow being prevented between the compression chamber and the discharge port through the intermediate discharge port when in a flow-blocked state, and fluid flow being enabled between the compression chamber and the discharge port through the intermediate discharge port when in a flow-permitted state.

2. The compressor according to claim 1, wherein the intermediate discharge port is disposed at a location of the compression chamber at which a fluid being compressed is partially compressed.

3. The compressor according to claim 1, wherein the compressor includes a plurality of intermediate discharge ports.

4. The compressor according to claim 1, wherein the intermediate discharge port includes a biasing mechanism for maintaining the sealing member in the flow-blocked state.

5. The compressor according to claim 1, wherein the sealing member further includes a reduced diameter portion having another diameter smaller than the diameter of the center portion, thereby forming a sealing edge on a surface of the center portion.

6. The compressor according to claim 5, wherein in the flow-blocked state, the sealing edge of the sealing member is sealingly engaged with a surface of the intermediate discharge port.

7. The compressor according to claim 1, wherein the sealing member is flush with the compression chamber in the flow-blocked state.

8. The compressor according to claim 1, wherein the diameter of the sealing member is about the same as the first diameter to provide a sealing engagement in the flow-blocked state.

9. The compressor according to claim 1, wherein a surface formed in the intermediate discharge port at a location at which the first portion and the second portion meet is configured to provide a sealing engagement for the sealing member in the flow-blocked state.

10. A heat transfer circuit, comprising:

a compressor, a condenser, an expansion device, and an evaporator fluidly connected, wherein the compressor includes:

a compressor housing;

a non-orbiting scroll member and an orbiting scroll member forming a compression chamber;

a discharge port for receiving a compressed fluid; and an intermediate discharge port fluidly connected between the compression chamber and the discharge port, the intermediate discharge port including:

a sealing member disposed within the intermediate discharge port, wherein the sealing member includes a center portion having a first diameter and a plurality of protrusions, fluid flow being prevented between the compression chamber and the discharge port through the intermediate discharge port when in a flow-blocked state, and fluid flow being enabled between the compression chamber and the discharge port through the intermediate discharge port when in a flow-permitted state.

11. The heat transfer circuit according to claim 10, wherein the intermediate discharge port is disposed at a location of the compression chamber at which a fluid being compressed is partially compressed.

12. The heat transfer circuit according to claim 10, wherein the compressor includes a plurality of intermediate discharge ports.

13. The heat transfer circuit according to claim 10, wherein the intermediate discharge port includes a biasing mechanism for maintaining the sealing member in the flow-blocked state.

14. The heat transfer circuit according to claim 10, wherein the sealing member further includes a reduced diameter portion having a second diameter smaller than the first diameter, thereby forming a sealing edge on a surface of the center portion.

15. The heat transfer circuit according to claim 14, wherein in the flow-blocked state, the sealing edge of the sealing member is sealingly engaged with a surface of the intermediate discharge port.

16. A method, comprising:

providing an intermediate discharge port at a location in fluid communication with a compression chamber of a scroll compressor, the location being such that when operating the compressor at part-load, a portion of a fluid being compressed is directed from the compression chamber toward a discharge plenum of the scroll compressor and is at a pressure that is lower than a discharge pressure of the compressor when operating at full-load, and when operating the compressor at full-load, the portion of the fluid being compressed remains in the compression chamber until reaching a discharge location of the compression chamber, the intermediate discharge port including a sealing member disposed within the intermediate discharge port, wherein the sealing member includes a center portion having a diameter and a plurality of protrusions.

17. The method according to claim 16, wherein the providing includes retrofitting the intermediate discharge port into the scroll compressor following manufacturing.

* * * * *